United States Patent [19]

Rummel et al.

[11] 4,244,796

[45] Jan. 13, 1981

[54] METHOD OF INFLUENCING THE DISTRIBUTION OF DIFFERENT CONSTITUENTS IN AN ELECTRICALLY CONDUCTIVE LIQUID

[75] Inventors: Theodor Rummel, Hanover, Fed. Rep. of Germany; Wilfried Heinemann, Richterswil, Switzerland

[73] Assignee: Concast AG, Zürich, Switzerland

[21] Appl. No.: 971,205

[22] Filed: Dec. 20, 1978

[30] Foreign Application Priority Data

Dec. 27, 1977 [CH] Switzerland ..... 16043/77

[51] Int. Cl.[3] ..... C25F 1/00; B22D 27/02

[52] U.S. Cl. ..... 204/140; 164/49

[58] Field of Search ..... 204/140; 13/27; 148/150, 154; 266/234; 164/48, 49, 250, 251

[56] References Cited

U.S. PATENT DOCUMENTS

| | | | |
|---|---|---|---|
| 2,290,083 | 7/1942 | Webster | 164/450 |
| 2,877,525 | 3/1959 | Schaaber | 164/49 |
| 3,746,074 | 7/1973 | Baumann | 164/250 |
| 3,842,895 | 10/1974 | Mehrabian | 164/49 |
| 3,878,073 | 4/1975 | Boorstein | 204/140 |
| 3,944,476 | 3/1976 | Gatellier | 204/140 |
| 3,953,308 | 4/1976 | Gatellier | 204/140 |
| 4,158,380 | 6/1979 | Sasaki | 164/250 |

*Primary Examiner*—T. M. Tufariello

*Attorney, Agent, or Firm*—Werner W. Kleeman

[57] ABSTRACT

A method of influencing the distribution of different constituents in an electrically conductive liquid, especially a molten metal, wherein an electrical current is conducted through the electrically conductive liquid and at the same time there is formed a magnetic field approximately perpendicular to the direction of flow of the electric current, in order to reduce or increase the effect of the differences in the density of the constituents.

3 Claims, 2 Drawing Figures

METHOD OF INFLUENCING THE DISTRIBUTION OF DIFFERENT CONSTITUENTS IN AN ELECTRICALLY CONDUCTIVE LIQUID

BACKGROUND OF THE INVENTION

The present invention relates to a new and improved method of influencing the distribution of different constituents or components in an electrically conductive liquid, especially a molten metal or bath.

It is already known to the art that forces acting upon different constituents of a liquid mixture have an effect upon the distribution of these constituents in such liquid. Hence, under the effect of the force of gravity the lighter constituents tend to collect at the upper region of the liquid and the heavier constituents at the lower region thereof. This irregular distribution generally is maintained upon solidification of the liquid. This process is known as "gravitational eliquation or segregation". The gravitational eliquation is generally undesired, except when it is used for separating constituents.

In order to fabricate high-grade types of steel there can be desired as homogenous as possible admixing of the constituents, or, however, a high purity or separation of different constituents. The differently heavy constituents of a solidifying melt can be uniformly distributed for instance by stirring. However, the danger exists that in doing so constituents which have already solidified will again detach and remix with the residual molten metal.

Further, it has been proposed to permit metals to solidify under space lab conditions. The different heavy insoluble constituents in a molten metal should thus distribute uniformly and there should be obtained an improvement in the structure, for instance in the form of a structure refinement. Due to such structural improvements of the material it is possible to influence the properties thereof, such as rupture strength, deformability and magnitizability. Production of materials under the aforementioned conditions is extremely limited due to reasons of cost.

Frequently the differences in the density are often not adequate for separating different constituents of a liquid. Therefore there are frequently employed centrifuges. Upon solidification under the action of centrifugal forces the contaminants collect at the center of the molten metal and influence the structure.

SUMMARY OF THE INVENTION

It is a primary object of the present invention to provide a new and improved method of influencing the distribution of different constituents in an electrically conductive liquid in a manner not associated with the aforementioned drawbacks and limitations of the prior art proposals.

Another and more specific object of the present invention aims at providing an economical method enabling influencing the distribution of different constituents of electrically conductive liquids, especially steel melts.

Now in order to implement these and still further objects of the invention, which will become more readily apparent as the description proceeds, the method aspects of the present invention are manifested by the features that an electrical current is conducted through the liquid and at the same time there is formed a magnetic field approximately perpendicular to the direction of flow of the electrical current, in order to change i.e., reduce or increase the effect of the differences in the density of the constituents.

For many fields of application it is advantageous to have as uniform as possible magnetic field. With the current flowing perpendicular to the magnetic field there is realized the largest possible effect as concerns the production of the forces.

With the inventive method it is possible to alter the effect of the densities of different constituents in electrically conductive liquids, and thus, on the one hand to eliminate demixing or separation effects, or, on the other hand, to intensify such demixing by increasing these differences.

The inventive method, which is economically far better than a space laboratory, enables randomly altering the mutual behavior of the density of the mixture components or constituents within predetermined limits. According to a further characteristic feature of the invention it is of advantage if the effect of the differences in the density of the constituents is eliminated. This renders possible, for instance the homogenous distribution of the constituents in a liquid, which either settle by virtue of their density or ascend to the surface.

According to a further feature of the invention, it can be advantageous if during the separation process the effect of the differences in the density of two constituents is at least doubled. If there is required a demixing or separation of the constituents, then this can be easily obtained by increasing by a multiple the density difference of the constituents.

The uniform distribution of constituents, in a solidified amorphous or crystalline structure, can constitute an appreciable qualitative feature. It is therefore of particular interest if the effect of the differences in the density of the constituents can be reduced or eliminated during the solidification of the steel melt. With the inventive method it is possible to realize physical conditions in a metallic melt as the same are only possible for instance in a space laboratory in a gravitationless state.

According to a further aspect of the invention it is recommend that there be employed an alternating current and a magnetic alternating field and that there be satisfied the following condition:

$$d \leqq \frac{1.7}{\sqrt{\pi \cdot f \cdot \mu \cdot H}}$$

wherein d constitutes the largest diagonal of the cross-sectional area disposed perpendicular to the direction of current flow, f the frequency, $\mu$ the permeability and H the electrical conductivity. In the case of circular cross-sections d constitutes the diameter and for polygonal cross-sections the largest diagonal. The alternating current can be of random frequency. It is also advantageous to employ a constant or steady field and direct current or a combination of both. It is advantageous to horizontally arrange the magnetic field and the direction of the current.

The magnetic force density of the magnetic forces, formed by the action of the electrical current and the magnetic field, is derivable from the following equation:

$$\vec{Pm} = \vec{S} \cdot \vec{B}$$

wherein, $\vec{Pm}$ = magnetic force density $\vec{S}$ = electrical current density $\vec{B}$=magnetic flux density, induction.

It is advantageous to maintain a minimum value of $B \geqq 0.05T$, so that the current density or current intensity which can cause pinch forces, need not be too large. Only in the case of alternating fields can there be given an upper limit of $B \leqq 0.3T$ if there are undesired induced electrical currents and the thus caused melt flow.

The force density acts upon the constituents of the liquid similar to the gravitational force. For most fields of application the common effect of the gravitational force and magnetic force must be taken into account. The resultant force is derived from $$P_{res} = Pm + g \cdot \rho$$

wherein, $P_{res}$=resultant force density $\rho$=density g=gravitational constant.

If the liquid consists of different electrically conductive constituents, then the electrical current is divided in such a manner that a greater current density prevails at the constituents having the better conductivity. Where there is present a greater current density there is also present a greater magnetic force density. Thus there prevails a randomly adjustable difference according to magnitude and direction, between the magnetic force densities in good and poor electrically conductive materials. Therefore, in the case of mixtures composed of two constituents it is always possible, and in the case of mixtures formed of a number of constituents possible to a limited extent, to overcome or randomly increase or reduce the uplift or boyant force caused by differences in the effect of the densities of the constituents of an electrically conductive liquid. Additionally, it is possible to influence the structure formation during solidification of the molten metal either by a complete or partial compensation of the force of gravity or by additionally augmenting the force of gravity. In this way there is obtained a particularly fine grained structure.

During separation of constituents, for instance during the removal of contaminants from a molten metal or bath, it is possible to augment the gravitational force, so that the contaminants having less good conductivity, such as for instance refractory materials, collect at the surface where they can be scooped off or otherwise removed.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
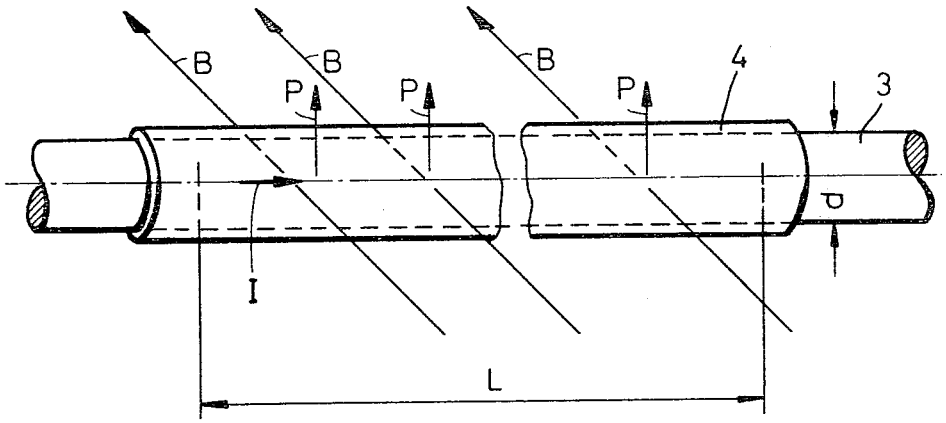
FIG. 1 schematically illustrates an arrangement for compensating the force of gravity.

Describing now the drawings, in FIG. 1 there is shown a section of a steel strand 3 having a circular cross-sectional area of a diameter d. Throughout a length L the steel is in a liquid phase and is surrounded throughout this length by a protective tube 4. The region L extends horizontally and there is produced in any conventional and suitable manner a current which flows in the lengthwise direction of the strand 3. There can be used in conventional manner as the current infeed means electrodes formed of steel, drag contacts or rolls which immerse in the molten metal. The electrodes advantageously consist of the same material as the molten metal or melt, so that melting of material of the electrodes cannot alter the composition of the molten metal. The standardly employed cooling devices for accelerating the solidification of the molten metal have been omitted from the showing of the drawings to simplify the illustration. The direction of the exciting magnetic field B is horizontal and essentially perpendicular to the direction of flow of the current I. In the drawings the magnetic field B has been shown schematically by the arrows B. The upwardly directed forces P, produced by the current I and the magnetic flux density B, correspond to the weight of the steel strand 3 over the length L.

During a laboratory test there were used the following conditions:

| | |
|---|---|
| Length of the molten region | L = 0.3 m |
| Diameter | d = 0.02 m |
| Density of the melt | $\rho$ = 7.8 g/cm$^3$ |
| Electrical conductivity | H = 0.72 m/$\Omega$mm$^2$ |
| Magnetic flux density | $\beta$ = 0.12 T |
| Permeability of the melt | $\mu = 0.4\pi \cdot 10^{-6}$Vs/Am |

In order to be able to ascertain whether there could be used the network frequency there was checked the following condition:

$$d \leqq \frac{1.7}{\sqrt{\pi \cdot f \cdot \mu \cdot H}}$$

The magnetic force density is equal to the vector product of the current density and the magnetic induction of the exciting magnetic field. Since the magnetic force density in this case should amount in magnitude to the specific weight of the molten metal, the requisite current density S is equal to the quotient of the specific weight and magnetic induction and can be expressed by the following equation:

$$S = \frac{\rho \cdot g}{B} = 637650 \text{ A/m}^2$$

By multiplying with the cross-sectional area there was obtained the current intensity I=200 A.

Therefore the power loss amounts to:

$$\frac{4 \cdot I^2 \cdot L}{H \cdot \pi \cdot d^2} = 53 \text{ Watts}$$

Figure 2:
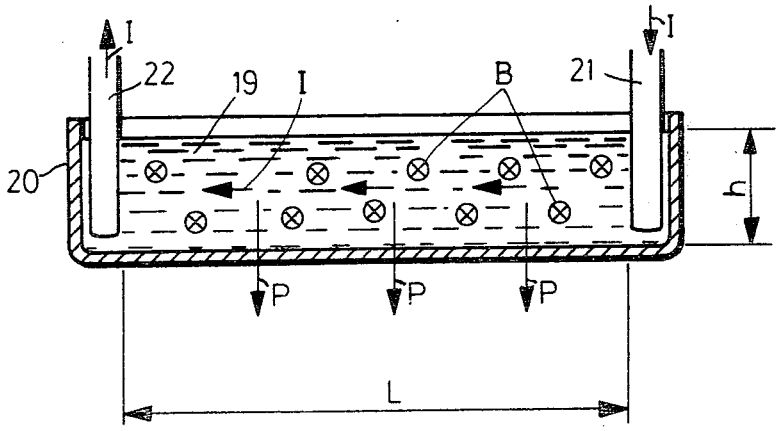
FIG. 2 schematically illustrates an apparatus for augmenting the force of gravity.

FIG. 2 illustrates a tin molten bath 19 having a height h and a width b within a substantially cross-shaped vessel or vat 20 in which there are located two immersible electrodes 21 and 22. Between these electrodes 21 and 22 there is produced a current I. The magnetic field B is directed into the plane of the drawing and the region under consideration again is designated by reference character L. In order to bring to the surface of the metal bath the contaminants which have a lesser electrical conductivity than the melt or in fact no electrical conductivity, and at which location they can be withdrawn, as by being scooped off, there is required a magnetic force density which is twice as large as the specific weight, so that the resultant force density is equal to the threefold specific weight. In this case there is used as the electrode material a chromium-nickel steel.

In the Example under consideration there were used the following parameters:

| | |
|---|---|
| Length of the melt | L = 0.5 m |
| Height of the molten bath | h = 0.1 m |
| Width of the molten bath | b = 0.1 m |
| Density of the melt | $\rho = 7.2\ g/cm^3$ |
| Electrical conductivity | $H = 2.1\ m/\Omega mm^2$ |
| Magnetic flux density | B = 0.05 T |
| Permeability of the Melt | $\mu = 0.4\pi \cdot 10^{-6} Vs/Am$ |

The cross-section which is dispositioned perpendicular to the horizontal direction of current flow is rectangular in this embodiment. The direction of the exciting magnetic field, like in the embodiment of FIG. 1, is horizontal and perpendicular to the direction of current flow.

The requisite current density was calculated as follows:

$$S = \frac{2\rho \cdot g}{B} = 2825280\ A/m^2$$

By multiplying with the cross-sectional area (b·h) there was derived the current intensity I=28.2 kA.

In the melt there thus exist a power loss of $I^2 \cdot L/H \cdot h \cdot b = 19 \cdot 16\ kW$.

The present method is basically usuable for all electrically conductive liquids and is not limited to molten metals. A great many fields of application are conceivable in combination with the known metallurgical methods. It is within the concepts of the invention that the claimed method be used both for liquid molten metals prior to solidification in containers, transport or throughflow vessels and the like or during the solidification with all presently known casting techniques.

The inventive method also enables realizing materials which at the present time are unknown. It is possible to retain for instance in suspension the most different type of constituents or components in electrically conductive liquids and to cause such to solidify with a desired distribution. Also this method enables fabricating materials having high degree of purity.

While there are shown and described present preferred embodiments of the invention, it is to be distinctly understood that the invention is not limited thereto, but may be otherwise variously embodied and practiced within the scope of the following claims. Accordingly,

What we claim is:

1. A method of influencing the distribution of different constituents in an electrically conductive liquid metal, comprising the steps of:

conducting an electric current through the liquid and at the same time forming a magnetic field approximately perpendicular to the direction of flow of the electric current, in order to increase the force of gravity of the constituents of the electrically conductive liquid.

2. The method as defined in claim 1, wherein:

the electric current and the magnetic field are employed for at least doubling the force of gravity of two constituents of the electrically conductive liquid.

3. The method as defined in claim 1, further including the steps of:

producing the electric current by means of an alternating current and the magnetic field by means of a magnetic alternating field;

and maintaining the conditions $$d \leqq \frac{1.7}{\sqrt{\pi \cdot f \cdot \mu \cdot H}}$$

wherein d represents the largest diagonal of the cross-sectional area disposed essentially perpendicular to the direction of current flow and is in the range of 1 m to 0.1 m, f represents the frequency, $\mu$ the permeability of $0.4\pi 10^{-6}$ Vs/Am, and H the electrical conductivity, and is in the range of 0.72 to 2.1 $m\Omega mm^2$.

* * * * *

UNITED STATES PATENT AND TRADEMARK OFFICE

CERTIFICATE OF CORRECTION

PATENT NO. : 4,244,796

DATED : January 13, 1981

INVENTOR(S) : Peter Hoyer, Theodor Rummel & Wilfried Heinemann

It is certified that error appears in the above-identified patent and that said Letters Patent are hereby corrected as shown below:

On the title page, column 1, section [75], before "Theodor Rummel,", insert --PETER HOYER, Schriesheim, Fed. Rep. of Germany--

Signed and Sealed this

*Second* Day of *June 1981*

[SEAL]

*Attest:*

RENE D. TEGTMEYER

*Attesting Officer*

*Acting Commissioner of Patents and Trademarks*